United States Patent [19]

Shimizu

[11] Patent Number: 4,884,520

[45] Date of Patent: Dec. 5, 1989

[54] LOOP TAKER AND SEWING MACHINE

[75] Inventor: Hiromitsu Shimizu, Osaka, Japan

[73] Assignee: Hirose Manufacturing Company, Limited, Osaka, Japan

[21] Appl. No.: 76,717

[22] Filed: Jul. 20, 1987

[30] Foreign Application Priority Data

Apr. 28, 1987 [JP] Japan ..... 62-105535

[51] Int. Cl.[4] ..... D05B 57/26

[52] U.S. Cl. ..... 112/231

[58] Field of Search ..... 112/181, 182, 192, 228, 112/230, 231

[56] References Cited

U.S. PATENT DOCUMENTS

| | | | |
|---|---|---|---|
| 296,106 | 4/1984 | Annett | 112/181 |
| 1,343,823 | 6/1920 | Hohmann | 112/228 X |
| 2,148,385 | 2/1939 | Waterman | 112/228 X |
| 2,690,726 | 10/1954 | Wener | 112/231 |
| 3,006,298 | 10/1961 | Johnson | 112/192 |
| 4,292,906 | 10/1981 | Johnson | 112/231 X |
| 4,523,534 | 6/1985 | Larsen | 112/231 |

FOREIGN PATENT DOCUMENTS 61-14368 5/1986 Japan .

*Primary Examiner*—Wm. Carter Reynolds

*Attorney, Agent, or Firm*—Wenderoth, Lind & Ponack

[57] ABSTRACT

A loop taker comprising a bobbin case holder in which is housed a bobbin whose axis is inclined relative to the rotational axis of a cup-shaped hook body in such a way that the bobbin is kept away from a path of needle movement, and also a sewing machine equipped with the loop taker. Thereby, it is possible to increase the outer diameter of the bobbin or increase the length of the bobbin, and it is possible to increase the quantity of bobbin thread wound on the bobbin.

17 Claims, 6 Drawing Sheets

LOOP TAKER AND SEWING MACHINE

BACKGROUND OF THE INVENTION

1. Field of the invention

This invention relates to a loop taker and a sewing machine.

2. Description of the Prior Art

A typical prior art arrangement is shown in FIG. 1. A horizontal axis full rotary loop taker has a cup shaped hook body 1 which supports a bobbin case holder 2 in position. In the bobbin case holder 2 there is mounted a bobbin case 5 shown by a phantom line for housing a bobbin 4 on which a bobbin thread 3 is wound. The hook body 1 is fixedly mounted on a horizontal rotary shaft 6 for rotation therewith. A needle 7, as arrows 8 show, is reciprocatingly movable up and down, the lowermost point of the path of its movement being shown by reference numeral 9. The rotation axis of the bobbin 4 is on a straight line coaxially or in parallel with the rotary shaft 6.

FIG. 2 is a sectional view of the hook body 1 in which the bobbin case holder 2 is housed. A bobbin case holder rib 10 formed on the outer periphery of the holder 2 is fitted in a hook groove 11 formed in the hook body 1.

A loop 13 of a needle thread 12 is seized by a loop seizing point 17, and as the hook body 1 rotates, the thread 12 progresses from its loop condition as shown in FIG. 3(1) into a loop state as shown in FIG. 3(2). The needle thread 12 passes itself through the loop while being in contact with a lower portion 14*a* of the bottom 14 of the bobbin case holder 2, and then it slides around the bottom 14 of the holder 2 as shown in FIG. 3(3).

In such a prior art arrangement, if the quantity of the bobbin thread wound on the bobbin 4 is to be increased, it is necessary either to (a) increase the outer diameter D of the bobbin 4 or to (b) increase the axial length H of the bobbin 4.

(a) In the case where the outer diameter D of the bobbin 4 is increased, the hook groove 11 in the hook body 1 and the rib 10 on the holder 2 are necessarily diametrically enlarged. Therefore, if the rotational speed of the hook body 1 is constant, the peripheral speed of the hook groove 11 will be increased. Accordingly, the frictional force between the hook groove 11 and the rib 10 will be increased. As a consequence, there will be an increase in the amount of heat released.

As a result of the increase in frictional force, considerable tension will be exerted on the needle thread 12 when the thread 12 passes through an abutment surface between a rotation restraining notch 15 of the bobbin case holder 2 and a stopper member which is in engagement with the notch 15. Thus, stitches are unfavorably tightened, which fact is likely to lead to incidental knotted needle thread or looping.

(b) For the purpose of increasing the axial length H of the bobbin 4, two approaches may be considered: (b1) the bobbin 4 is extended toward the open end side (rightward in FIG.1) of the bobbin case holder 2, and (b2) the bottom 14 of the bobbin case holder 2 is extended leftward in FIG. 1, while the bobbin 4 is extended toward the bottom 14 side.

In the case where the (b1) approach of extending the bobbin 4 toward the open end side of the case holder 2 is adopted, the trouble is that in the up and down reciprocating movement of the needle 7, the needle point will be lowered radially inwardly of the radially outer side of the bobbin thread 3 wound on the bobbin 4, when it is lowered to the lowermost point 9 of needle movement, so that the needle 7 will run into the bobbin thread 3 wound on the bobbin 4, whereby breakage may be caused to the bobbin thread 3 wound on the bobbin 4.

In the case where the (b2) approach of extending the bottom 14 of the bobbin case holder 2 leftward in FIG. 1 is adopted, as FIG. 4 shows, the resulting configuration is such that the prior arrangement of them bottom 14 shown by a phantom line is extended leftward in FIG. 4. As such, the needle thread 12 is caught in the lower portion 14a of the bottom 14 of the bobbin case holder 2 and thus thread passing is rendered impossible, with the result that sewing is made impossible.

SUMMARY OF THE INVENTION

The object of this invention is to provide a loop taker and sewing machine which eliminates the aforesaid problems arising from increasing the outer diameter D of the bobbin 4 or increasing the length H of the bobbin 4 in the prior art arrangement shown in FIGS. 1 through 4, thereby making it possible to increase the quantity of bobbin thread wound on the bobbin.

In accomplishing the above object, a loop taker according to the invention comprises a bobbin case holder in which is housed a bobbin whose axis is inclined relative to the rotational axis of a cup-shaped hook body in such a way that the bobbin is kept away from a path of needle movement.

In a preferred embodiment, the loop taker is a horizontal axis full rotary loop taker.

Furthermore, in the preferred embodiment, the loop taker is an oscillating loop taker.

In a further preferred embodiment, a bottom of the bobbin case holder is generally perpendicular to the axis of the bobbin.

Furthermore, in the preferred embodiment, an angle between the axis of the bobbin and the rotational axis of the hook body is 5 degrees or above.

Further, in accomplishing the above object, a sewing machine according to the invention comprises a loop taker having a bobbin case holder in which is housed a bobbin whose axis is inclined relative to the rotational axis of a cup-shaped hook body in such a way that the bobbin is kept away from a path of movement of the needle.

According to the invention, it is possible to increase the outer diameter of the bobbin and/or the axial length of the bobbin by inclining the axis of the bobbin relative to the rotational axis of the hook body. Thus, it is possible to increase the quantity of bobbin thread wound on the bobbin. In this case, it is unnecessary to increase the outer diameter of the rib of the bobbin case holder for housing the bobbin. Therefore, the hook body of the existing arrangement may be employed as it is. The needle thread delivery of any existing needle thread take-up may also be used as it is and need not be changed. Therefore, the invention eliminates all such problems as increased heat generation, unfavorable stitch tightness, thread breakage, and needle thread passing difficulty, which have been mentioned earlier in conjunction with the prior art arrangement.

According to the invention, the axis of the bobbin is inclined relative to the rotational axis of the hook body so as to enable the bobbin to keep itself away from the path of needle movement. Therefore, it is possible to increase the outer diameter of the bobbin or the axial length of the bobbin by utilizing the existing idle space of the hook body, and thus to increase the quantity of bobbin thread winding.

Furthermore, according to the invention, the hook body of the conventional arrangement may be employed as such; and the quantity of thread delivery of the needle thread take-up may continue to be as heretofore. By changing at least the bobbin case holder and the bobbin, the invention can be effectively and advantageously applied in conjunction with existing sewing machines in a wide range of sewing activity areas.

BRIEF DESCRIPTION OF THE DRAWINGS

These and other objects, features and advantages of the invention will become more apparent upon a reading of the following detailed specification with reference to the drawings, in which.

DETAILED DESCRIPTION OF THE PREFERRED EMBODIMENTS

Figure 1:
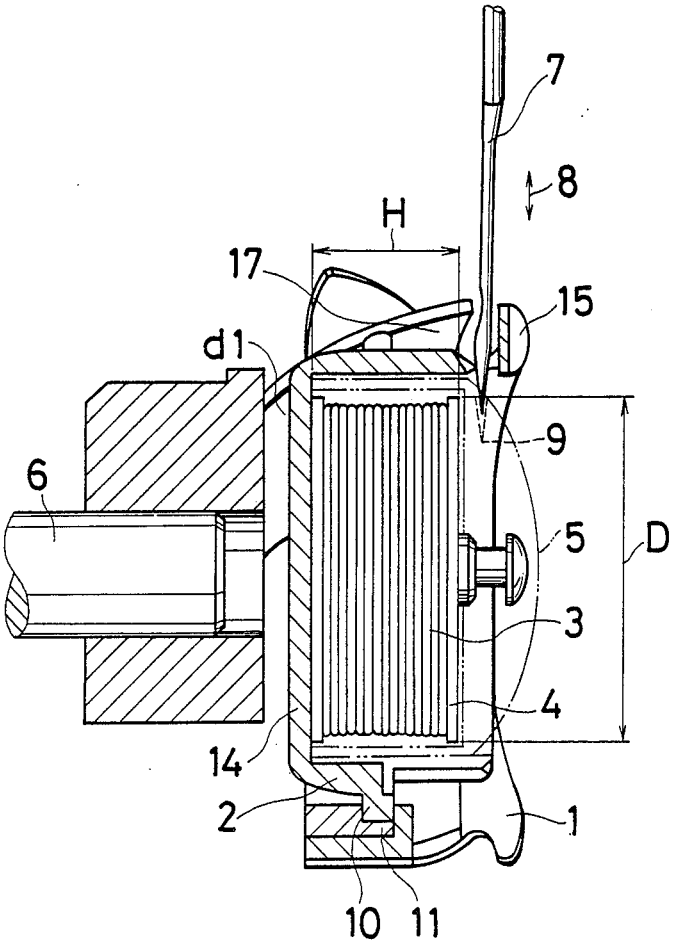
Fig. 1 Prior Art
FIG. 1 is a sectional view showing a prior art arrangement.
Figure 2:
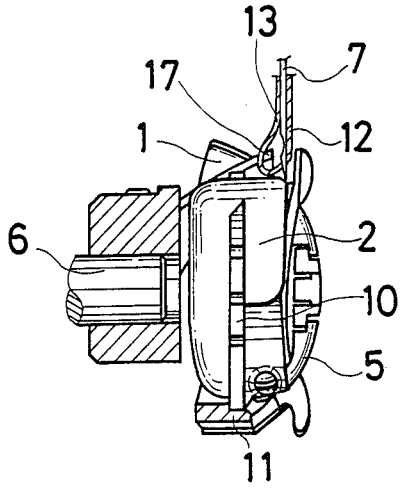
Fig. 2 Prior Art
FIG. 2 is a sectional view in side elevation showing a bobbin case holder in the prior art arrangement in FIG. 1.
Figure 4:
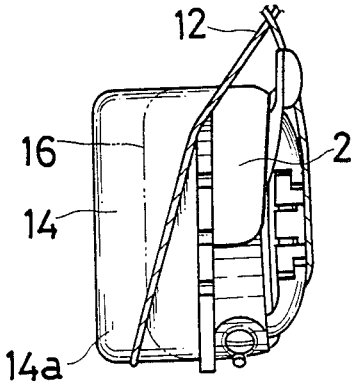
Fig. 4 Prior Art
FIG. 4 is a side view of the bobbin case holder for illustration of problems of the prior art arrangement.
Figure 3:
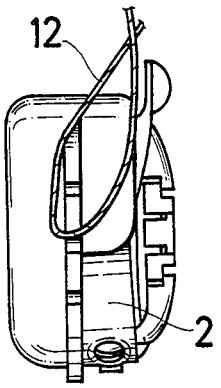
Prior Art Fig. 3(1)
FIGS. 3(1)–3(3) are side views illustrating aspects of operation of the prior art arrangement.
Figure 3:
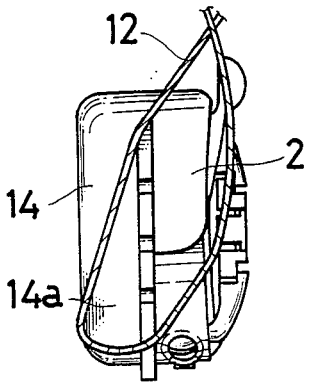
Prior Art Fig. 3(2)
Figure 3:
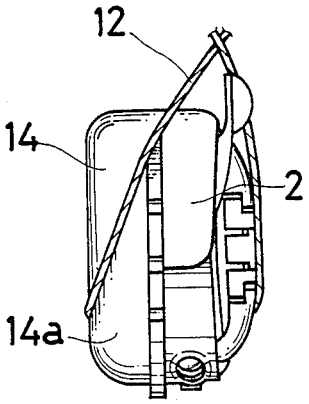
Prior Art Fig. 3(3)

Referring now to the drawings, embodiments of the invention are described below.

Figure 5:
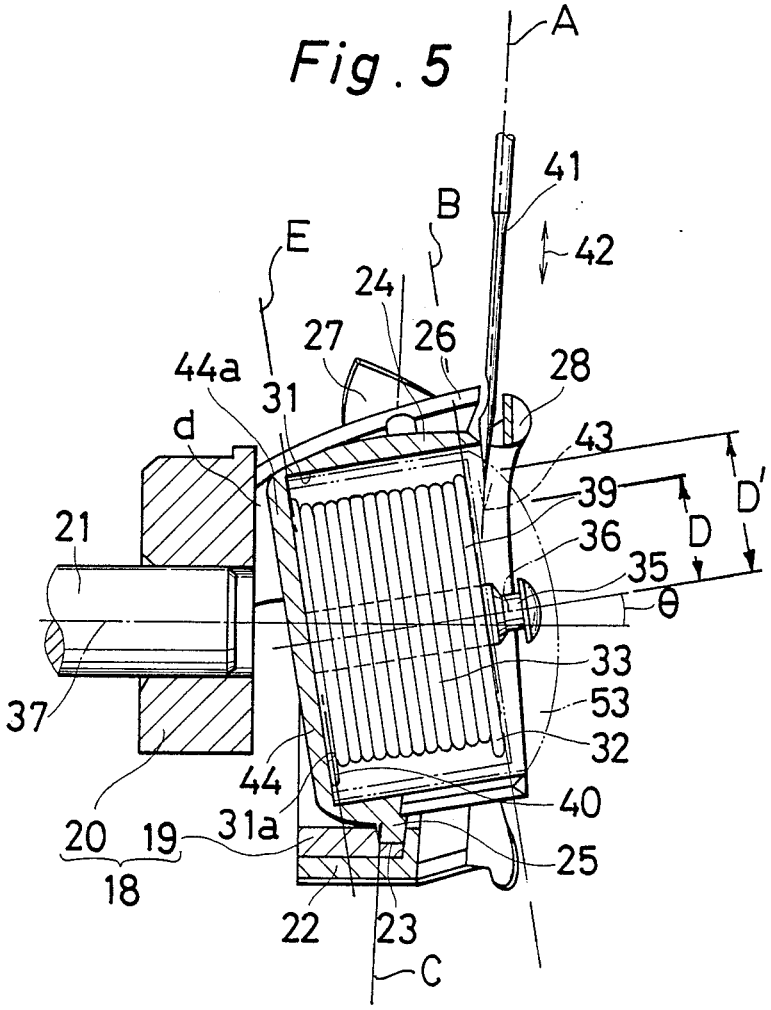
FIG. 5 is a sectional view showing one embodiment of the invention.
Figure 6:
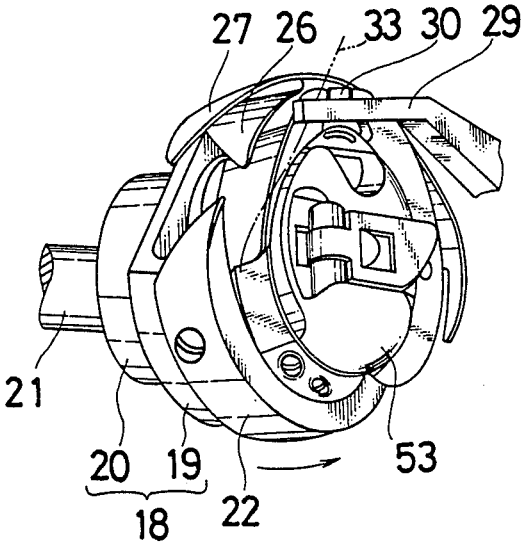
FIG. 6 is a perspective view of the embodiment shown in FIG. 5.
Figure 7:
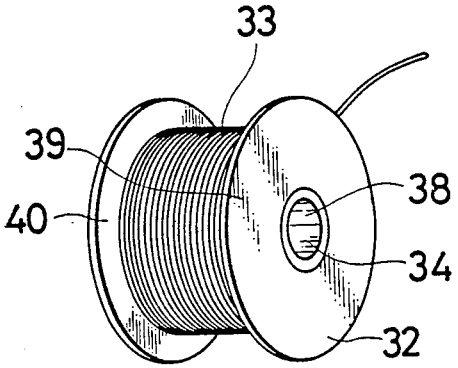
FIG. 7 is a perspective view of a bobbin shown in FIG. 5.

FIG. 5 is a sectional view showing one embodiment of the invention, and FIG. 6 is a perspective view thereof. A cup-shaped hook body 18 includes a hook body proper 19 and a mounting portion 20. The mounting portion 20 is fixed to a rotary shaft 21 having a horizontal mounting axis. A rotating hook section 22 is fixed to the hook body proper 19 to define a hook groove 23. The hook groove 23 extends circumferentially within an imaginary plane perpendicular to the rotational axis of the rotary shaft 21. On the outer periphery of bobbin case holder 24 there is formed a bobbin case holder rib 25 which fits in the hook groove 23 so as to be supported by the hook body 18, the rib lying in a plane C which is substantially parallel to the path of needle movement. The hook body 18 has a loop seizing point 26 and a spring 27. A protrusion 30 of a rotating restraining member 29 fixed to a sewing machine body or the like is fitted in a rotation restraining notch 28 formed in the bobbin case holder 24, being thereby retained. In a recess 31 of the holder 24 there is mounted a bobbin case 53 housing a bobbin 32 shown in FIG. 7.

A bobbin thread 33 is wound on the bobbin 32. The bobbin 32 has a center hole 34 through which a stud or shaft 35 extends, said stud 35 being mounted on a bottom 31*a* of a housing recess 31 of the bobbin case holder 24 in perpendicular relation thereto. The axis of the stud 35, that is, a rotational axis 36 of the bobbin 32, is inclined at an angle of $\theta$ relative to a rotational axis 37 of the hook body 18 such that the axis 36 extends out of an open end of the bobbin case holder in a upwardly inclined direction with respect to the horizontal axis 37 of the hook body. The bobbin 32 has a cylindrical body 38 on which bobbin thread 33 is wound and which is formed with the center hole 34 through which the stud 35 extends, and also has a pair of flanges 39, 40 fixed to the cylindrical body 38 at both ends thereof. A needle 41 is movable up and down in the directions of arrows 42, the lowermost point of the needle 41 in the path of its movement being shown by reference numeral 43. Flanges 39, 40 extend in respective planes B, E inclined to the path of needle movement at an angle between 0° and 90°. The angle $\theta$ of the axis 36 of the bobbin 32 is determined in such a way that the bobbin 32 is kept away from the path of movement of the needle 41 which extends upward and downward in FIG. 5 and such that the needle 41 may not strike the flange 39 at the lowermost point 43 of needle movement, the path of needle movement being along a needle axis A which intersects a plane B containing one axial end of the bobbin, the plane being perpendicular to the axis of the bobbin and the path of needle movement terminating at a point spaced from the axis of the bobbin by a distance D less than a distance D′ between the axis of the bobbin and a radially outermost point of the bobbin; for example, the angle $\theta$ is 5 degrees or above.

By inclining the axis 36 of the bobbin 32 at angle $\theta$ relative to the rotational axis 37 of the hook body 18 in this way it is possible to increase the outer diameter of flanges 39,40 of the bobbin 32 or increase the length of the bobbin 32, that is, the axial length of the cylindrical body 38 to which the flanges 39,40 are coupled and on which bobbin thread 33 is wound; and thus it is possible to increase the quantity of bobbin thread winding 33 by as much as 50%, for example, over the aforesaid prior art arrangment.

Figure 8:
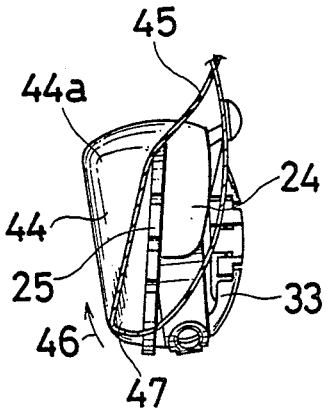
FIG. 8 is a side view of a bobbin case holder shown in FIG. 5.

The bottom 44 of the bobbin case holder 24 is generally flat and the upper end 44*a* of the bottom 44 is only required to be spaced from the hook body by a very small gap d enough to permit the passage of the needle thread. As shown in FIG. 8, the bottom 44 is inclined to a plane containing the rib 25. Therefore, it is possible to utilize a comparatively large gap d1 present in a conventional arrangement as shown in FIG. 1 for the purpose of the invention, thus ensuring most effective and advantageous utilization of any available idle space. In the prior art, the flange side surfaces of the bobbin 32 on the open end side of the bobbin case holder 24 can not be allowed to extend beyond the up and down needle position on said open end side. In the present embodiment, on the other hand, the flange side surfaces of the bobbin 32 can be allowed to extend on said open end side at a level lower than the lowermost point 43 of needle movement, irrespective of the path of needle 41 movement. In this respect, too, any idle space can be advantageously utilized for the purpose of the invention. According to the invention, the hook body may be of any conventional construction; it is only necessary that the bobbin case holder 24, the bobbin 32, and the bobbin case 53 should be replaced by those according to the invention. Thus, the invention provides the advantage that the amount of bobbin thread winding can be remarkably increased.

Furthermore, the bottom 44 of the bobbin case holder 24, as FIG. 8 shows, is configured so as to be expanded on the base end side of the hook body 18 (left-hand side of FIGS. 5 and 8) toward the upper end 44*a*. This enables the needle thread 45 to smoothly slide on the bottom 44 in the direction of arrow 46 without the needle thread 45 being caught at the lower portion 47 of the bottom 44, accurate thread passage being thus made possible.

The invention provides a further advantage that, as already mentioned, when the bobbin case holder 24, bobbin 32, and bobbin case 53 according to the invention are mounted in a conventional sewing machine in order to increase the amount of bobbin thread 33 winding, there is no necessity of changing the amount of thread delivery of the needle thread take-up in the machine. This assures easy application of the invention in conjunction with any conventional sewing machine.

In another embodiment of the invention, this invention can be applied in conjunction with a sewing machine in which the bobbin case holder 24 and the bobbin case 53 are integrally incorporated. The bobbin case holder 24 need not be provided with a stud 35.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

I claim:

1. A loop taker comprising a bobbin case holder in which is housed a bobbin whose axis is inclined relative to the rotational axis of a cup-shaped hook body in such a way that the bobbin is kept away from a path of needle movement, the path of needle movement being along a needle axis which intersects a plane containing one axial end of the bobbin, the plane being perpendicular to the axis of the bobbin and the path of needle movement terminating at a point spaced from the axis of the bobbin by a distance less than a distance between the axis of the bobbin and a radially outermost point of the bobbin.

2. A loop taker as claimed in claim 1, wherein the loop taker is a horizontal axis full rotary loop taker.

3. A loop taker as claimed in claim 1, wherein a bottom of the bobbin case holder is generally perpendicular to the axis of the bobbin.

4. A loop taker as claimed in claim 1, wherein an angle between the axis of the bobbin and the rotational axis of the hook body is 5 degrees or above.

5. A loop taker as claimed in claim 1, wherein the bobbin case holder includes a rib extending circumferentially around at least part thereof, the rib lying in a plane which is substantially parallel to the path of needle movement, a bottom of the bobbin case holder being inclined to the plane containing the rib, the hook body including a groove in which the rib is received.

6. A loop taker as claimed in claim 1, wherein the rotational axis of the hook body is horizontal, the path of needle movement is vertical and the axis of the bobbin extends from a bottom wall of the bobbin case holder and out of an open end of the bobbin case holder in an upwardly inclined direction with respect to the rotational axis of the hook body.

7. A loop taker as claimed in claim 12, wherein the loop taker is a full rotary loop taker.

8. A loop taker as claimed in claim 1, wherein the bobbin comprises a pair of spaced-apart flanges between which thread is held on a cylindrical body of the bobbin, the flanges lying in planes which are inclined to the path of needle movement at an angle greater than 0 degrees and less than 90 degrees.

9. A sewing machine comprising a loop taker having a bobbin case holder in which is housed a bobbin whose axis is inclined relative to the rotational axis of a cup-shaped hook body in such a way that the bobbin is kept away from a path needle movement, the path of needle movement being along a needle axis which intersects a plane containing one axial end of the bobbin, the plane being perpendicular to the axis of the bobbin and the path of needle movement terminating at a point spaced from the axis of the bobbin by a distance less than a distance between the axis of the bobbin and a radially outermost point of the bobbin.

10. A loop taker as claimed in claim 9, wherein the loop taker is a horizontal full rotary loop taker.

11. A loop taker as claimed in claim 6, wherein the loop taker is a horizontal axis full rotary look taker.

12. A loop taker as claimed in claim 6, wherein a bottom of the bobbin case holder is substantially perpendicular to the axis of the bobbin.

13. A loop taker as claimed in claim 6, wherein an angle between the axis of the bobbin and the rotational axis of the hook body is at least 5 degrees.

14. A loop taker as claimed in claim 6, wherein the bobbin case holder includes a rib extending circumferentially around at least part thereof, the rib lying in a plane which is substantially parallel to the path of needle movement, a bottom of the bobbin case holder being inclined to the plane containing the rib, the hook body including a groove in which the rib is received.

15. A loop taker as claimed in claim 6, wherein the rotational axis of the hook body is horizontal, the path of needle movement is vertical and the axis of the bobbin extends from a bottom wall of the bobbin case holder and out of an open end of the bobbin case holder in an upwardly inclined direction with respect to the rotational axis of the hook body.

16. A loop taker as claimed in claim 13, wherein the loop taker is a full rotary loop taker.

17. A loop taker as claimed in claim 6, wherein the bobbin comprises a pair of spaced-apart flanges between which thread is held on a cylindrical body of the bobbin, the flanges lying in planes which are inclined to the path of needle movement at an angle greater than 0 degrees and less than 90 degrees.

* * * * *